United States Patent [19]

Nakayama

[11] 4,296,488

[45] Oct. 20, 1981

[54] WATCH MOVEMENT CONSTRUCTION

[75] Inventor: Yasuaki Nakayama, Hanno, Japan

[73] Assignee: Citizen Watch Company Limited, Tokyo, Japan

[21] Appl. No.: 918,010

[22] Filed: Jun. 22, 1978

[30] Foreign Application Priority Data

| | | | |
|---|---|---|---|
| Jun. 28, 1977 | [JP] | Japan | 52/77029 |
| Nov. 24, 1977 | [JP] | Japan | 52/141033 |
| Dec. 21, 1977 | [JP] | Japan | 52/153715 |

[51] Int. Cl.[3] ..... G04B 19/04; G04C 23/02

[52] U.S. Cl. ..... 368/80; 368/88

[58] Field of Search ..... 58/23 D, 23 BA, 7, 59, 58/104, 23 AC, 52; 29/177; 368/80, 88, 76, 155-157, 160

[56] References Cited

U.S. PATENT DOCUMENTS 4,087,957 5/1978 Miyasaka ..... 58/104

*Primary Examiner*—Vit W. Miska

*Attorney, Agent, or Firm*—Jordan and Hamburg

[57] ABSTRACT

A movement construction of a thin, quartz wristwatch with the movement having a thickness less than 2.5 mm, in which a flat coil is adopted as the driving coil of a stepping motor, and a wheel train is disposed in an approximate concentric relationship with said coil.

34 Claims, 8 Drawing Figures

WATCH MOVEMENT CONSTRUCTION

This invention relates to a movement construction of an electronic wristwatch, and more particularly to the watch movement construction adapted to be accommodated in a thin, quartz wristwatch.

Even the thinnest prior art quartz wristwatches have a movement thickness approximately equal to 2.9 mm. Since thinner movements such as are found in mechanical wristwatches have not been available for quartz wristwatches, it has not been possible to manufacture thinner, lighter and more attractive quartz wristwatches comparable to a mechanical wristwatch having a movement with a thickness of less than 2.5 mm. The reason for this is that it has been difficult to reduce the size and thickness of such component parts as the coil and rotor that constitute a quartz wristwatch, and because the arrangement of these parts within the movement has been quite complicated, making it difficult to reduce overall size and thickness.

The present invention overcomes the difficulties encountered in the prior art and provides an extremely thin movement having a thickness of less than 2.5 mm, thereby making it possible to obtain a quartz wristwatch having an extremely thin design.

Figure 1:
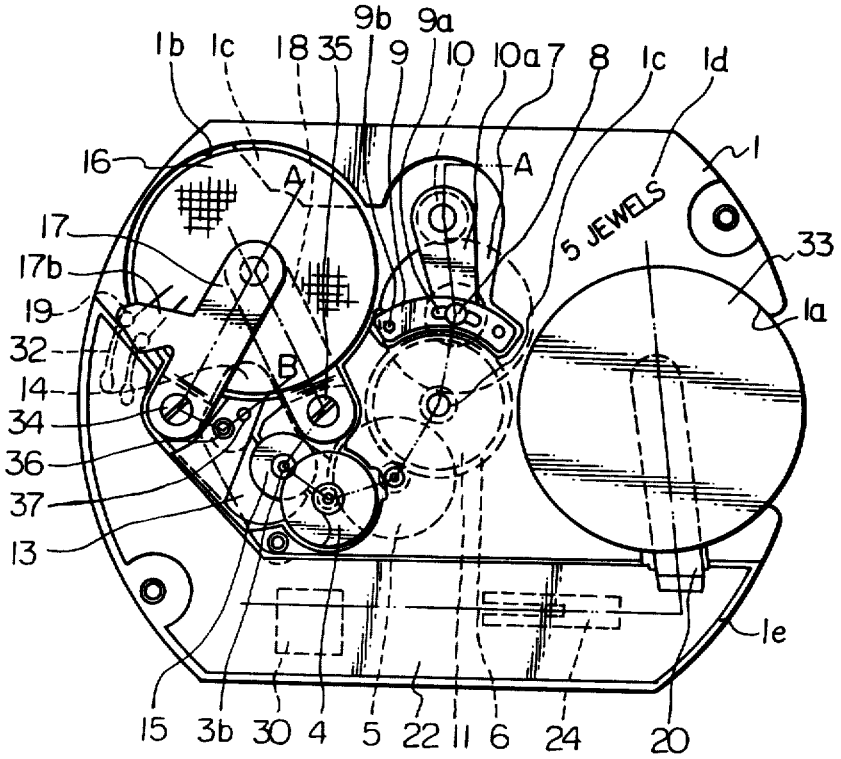
FIG. 1 is a plan view of a movement construction for an electronic wristwatch according to the present invention.

FIG. 1 is a plan view of a preferred embodiment of a watch movement construction for an electronic wristwatch in accordance with the present invention. A base plate 1 that defines an external configuration of the movement has right and left sides that are rounded and top and bottom sides that are linear and parallel. The base plate 1 has a cutout 1*a* formed adjacent an outer periphery of the base plate, and adapted to be open thereto. A battery 33 is disposed in cutout 1*a* at the right side of the movement so that at least a portion of an outer periphery of the battery 33 forms part of the outer or external configuration of the movement. A lead plate 20 serving as a negative electrode is located below the bottom surface of the battery and extends to and connected to the right edge portion of a circuit board 22 disposed between watch dial 46 and back cover 40. The circuit board 22 is disposed in third cutout 1*e* formed in close proximity to the left and bottom sides of the movement. Printed on the upper surface of plate 1 is a mark 1*d*. A quartz crystal vibrator 24 and an IC chip 30 are mounted on the surface of circuit board 22. A flat, cylindrical or a disk type driving coil 16 of a stepping motor is disposed in second cutout 1*b* formed in close proximity to the outer edge thereof and is embraced by upper and lower yokes 17, 18 bonded thereto. The upper and lower yokes 17, 18 are tightly secured by screws 34, 35 to both ends of a stator 13 extending in a space between back cover 40 and watch dial 46. The stator 13 has a rotor in its opening and is integrally welded to a plate member 14 positioned on and fixed to base plate 1 by screw 36 and pin 37. Thus, coil 16 with yokes 17, 18 secured thereto can be attached to and removed from the movement in a direction perpendicular thereto, thereby facilitating assembly and disassembly. Coil 16 is soldered to the underside of a projection 17*b* on upper yoke 17, which projection 17*b* is provided with a terminal 19 that contacts a contact spring 32 secured to circuit board 22. This portion can also be formed by securing terminal 19 directly to coil 16. Located below the bottom surface of coil 16 so as to restrict its movement in an axial direction are a thinned portion 1*c* of base plate 1 and a portion of the plate 14. It is also permissible to adopt the same means at the top side of the coil. Other modifications of means for supporting the coil 16 may include packing a piece of rubber in a clearance located between the outer periphery of the coil and the cutout 1*b* of base plate 1, applying an adhesive to the location of the clearance, extending a portion of the upper and lower yokes 17, 18 to the position of the base plate 1 and then securing them to the plate by screws, or bonding a non-magnetic plate to the flat surface of the coil and securing the non-magnetic plate to the plate 1 by screws.

As will be described later, the coil 16 is rather heavy owing to its large outside diameter so that repeated impact applied to the wristwatch can lead to deformation, and a reduction in the magnetic characteristics, of the upper and lower yokes 17, 18 which are made of a soft, permalloy that undergoes a drastic decrease in permeability when subjected to strain. It is therefore necessary to prevent such an occurence.

A reduction wheel train is disposed at a central portion of the movement in an area between the cylindrical driving coil 16 and the battery 33 and rotatably mounted on the base plate 1. A fourth wheel and pinion 4 meshes with a rotor pinion 3*b* on the top side of a rotor box 15, and a third wheel and pinion 5 and a center wheel and pinion 6 are disposed below the bottom side of plate 1. A minute wheel 7 has a stationary minute wheel pin 8 loosely fitted into an oblong hole 9*a* of a guide plate 9. Guide plate 9 is secured to plate 1 by weld joints 9*b*. The minute wheel pin 8 is loosely fitted into a setting wheel lever 10*a* which is in turn loosely fitted into a setting wheel 10. Thus, as will be described later, setting wheel 10 will be able to mesh without difficulty even if its center is slightly displaced. The wheel train has an hour wheel 11 rototably supported by base plate 1 at the central portion of the movement.

By enlarging the outside diameter of coil 16 to the point where it is closely adjacent to center wheel and pinion 6 and hour wheel 11, and by adopting windings that are as thick as possible, the conversion efficiency of the coil can be raised and its power consumption reduced so that the small button-type battery 33 will operate for at least one year.

Figure 2:
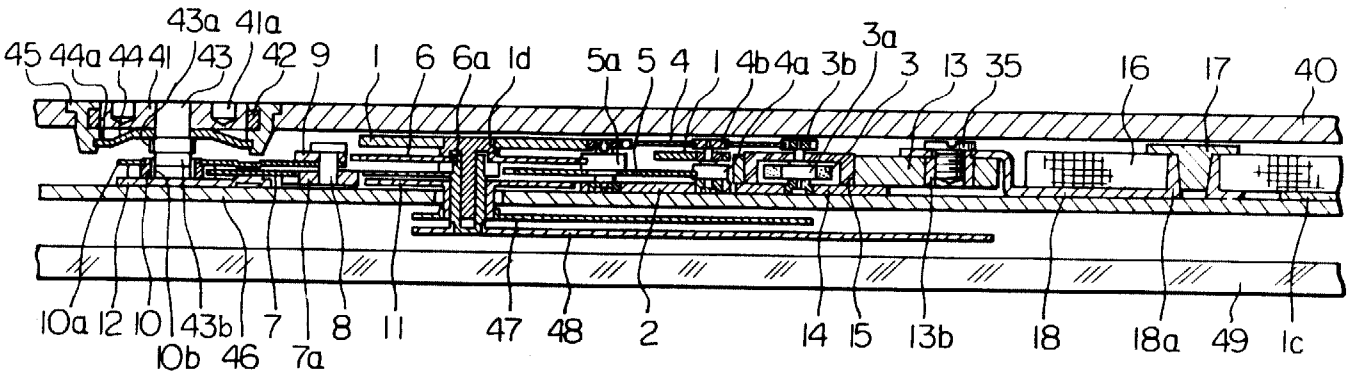
FIGS. 2, 3 and 4 are cross-sectional views taken along the lines A—A, B—B and C—C of FIG. 1.

FIG. 2 is a cross-sectional view taken along the line A—A of FIG. 1. On the left side of the drawing, the central hole of setting wheel 10, into which is loosely fitted setting wheel lever 10*a*, is provided with a slender inner tooth 10*b*. A hand winder shaft 43 secured to a hand winder plate 41 loosely fitted into a hand winder shaft frame 45 that is in turn fitted into back cover 40 has a smooth tip 43*b* that is loosely disposed in inner tooth 10*b* of setting wheel 10 during normal operation, and a smooth outer tooth 43*a* at its central portion that meshes with inner tooth 10*b* when the hands of the wristwatch are being set. The hands are set by turning a suitable tool that has been inserted and pressed into two holes 41*a* formed in the hand winder plate. A spring 44 the outer circumferencial portion of which is fit into hand winder shaft frame 45 and the inner circumferencial portion of which is embraced between hand winder plate 41 and hand winder shaft 43 so as to be firmly secured has the capability of restoring hand winder plate 41 to its original position. A flat portion 44*a* about the outer edge of spring 44 serves as a stopper when winder plate 41 is depressed. A waterproof packing is designated at 42.

Minute wheel 7 which engages with setting wheel 10 has a minute wheel pinion 7*a* of which minute wheel pin 8 serves as the center of rotation. The structure surrounding guide plate 9 is as described above with reference to FIG. 1. Thus, according to this arrangement, the centers of hand winder shaft 43 and setting wheel 10 can remain in coincidence even if the movement and back cover 40 are slightly displaced.

Reference numeral 12 denotes a minute wheel bridge adapted to support setting wheel 10 and minute wheel 7 from below their bottom surfaces. An hour hand 47 is fixed to hour wheel 11 that meshes with minute wheel pinion 7*a*. A minute hand 48 is fixed to center wheel pinion 6*a* that meshes with minute wheel 7. Center wheel 6 is supported by the center shaft 1*d* implanted in plate 1. Fifth wheel and pinion 5 which includes the fifth wheel pinion 5*a*, and fourth wheel and pinion 4 which includes the fourth wheel pinion 4*a* are supported by bearings secured to plate 1 and wheel train bridge 2. As fourth wheel and pinion 4 is located on the topside of plate 1, a washer 4*b* makes it possible to remove the wheel and pinion. Stator 13 located midway between the top and bottom surfaces of the movement has an acetal resin rotor box 15 pressed into and secured in its opening, the rotor box housing a magnet 3 bonded and secured to a rotor stem 3*a*. Rotor stem 3*a* is supported in the central hole of rotor box 15 and has rotor pinion 3*b* pressed and secured into one extended end. Reference numeral 14 denotes the plate described above with reference to FIG. 1, the plate being adapted to support the lower end of rotor stem 3*a* by means of bearings. This structure thus allows magnet 3 to be handled together with stator 13 during disassembly and cleaning without iron particles being attracted to the magnet.

Lower yoke 18 formed to include a core portion 18*a* having a tapered bore corresponding to the center of flat coil 16 is tightly secured to stator 13 by tightening screw 35 into a nut 13*b* embedded in the stator. Reference numeral 17 denotes the upper yoke, and 1*c* the thinned portion of plate 1 for supporting coil 16 from below its bottom surface, as already described with reference to FIG. 1. A watchglass is designated at 49.

Figure 3:
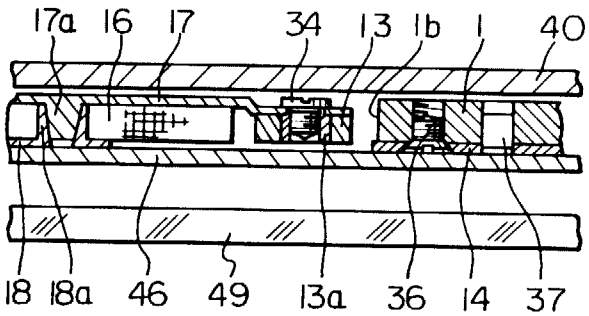

FIG. 3 is a cross-sectional view taken along the line B—B of FIG. 1. Upper yoke 17 formed to include a tapered projection 17*a* that fits into the hole of the core portion 18*a* of lower yoke 18 is bonded to coil 16 and secured to stator 13 by tightening screw 34 into nut 13*a* embedded in the stator. In the core portion 18*a*, the yokes are tapered in order to improve the connection and fit between them.

On the right side of the drawing plate 14 is shown welded and secured to stator 13. The plate 14, including the stator 13, is positioned on and secured to plate 1 by screw 36 and pin 37. In other words, in order to provide extremely thin timepieces, since sufficient thickness cannot be provided for plate 1 for allowing stator 13 to be directly secured to plate 1, stator 13 should preferably be connected to plate 1 by means of plate 14.

Figure 4:
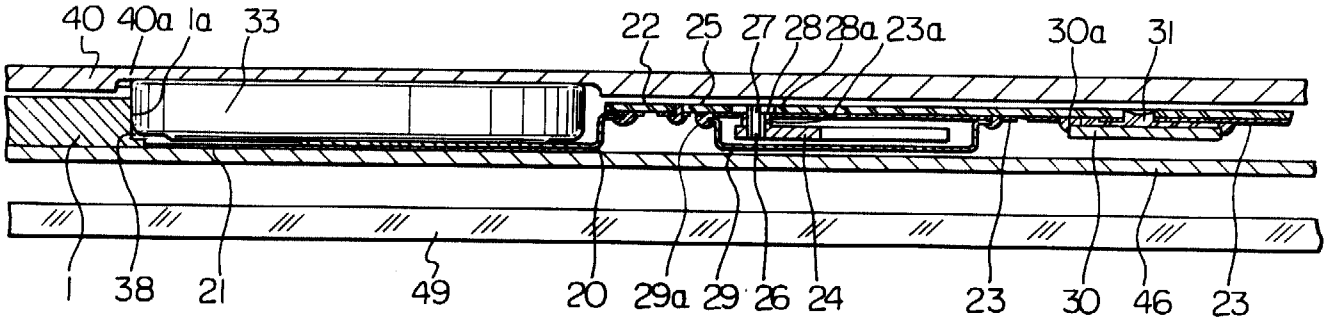

FIG. 4 is a cross-sectional view taken along the line C—C of FIG. 1. The stepped portion of plate 1 is provided with a ring-shaped piece of rubber 38 to prevent excessive movement of battery 33 along its bottom surface and to compensate for any discrepancies in the working precision of the shoulder portion of the battery. Back cover 40 has a recess 40*a* located above the top surface of the battery, and located below the bottom surface of the battery and an insulating plate 21 on the top surface of watch dial 46 is a corrugated lead plate 20. A lead wire 25 connected to the electrode of quartz crystal vibrator 24 and secured by an epoxy resin 26 in a hole located in the base of the vibrator is soldered to a wiring pattern on a copper sheet 23 of the circuit board 22. Quartz crystal vibrator 24 is bonded and secured to a portion 23*a* formed by a drawing process applied to the copper sheet 23 which is slightly thicker than the copper foil of a commonly used printed circuit board. A ring 28 formed by filling glass with a koval material is fitted over the projection 23*a* and sealed by solder 28*a*. A cover 29 is similarly sealed to the copper sheet 23 by means of solder 29*a*. The overall structure can thus be made extremely thin.

At the right side of FIG. 4, the IC chip 30 is subjected to a flip chip-type bonding process by being connected and fixed by a solder 30*a*. Reference numeral 31 denotes a moisture-proofing resin.

Although there are limits upon the volume and electrical capacity of battery 33, it is possible to further reduce the thickness of the wristwatch and increase the life of the battery in relation to power consumption and battery specifications. In such a case, the battery leads would be led to the outside of the case by means of a metallic foil, and the leads would then be connected to the battery secured by means of solder. This would permit a substantial reduction in the thickness of the movement.

In accordance with the present invention as described above, a cylindrical, flat coil is effectively disposed in a wristwatch movement and supporting means is provided for supporting the weight of the coil so that the outside diameter of the coil can be enlarged. This has the effect of providing a thin highly efficient movement capable of operating sufficiently on a small, button-type battery. The movement is also advantageous since the coil can be installed and removed from one side for assembly, disassembly and cleaning.

Figure 6:
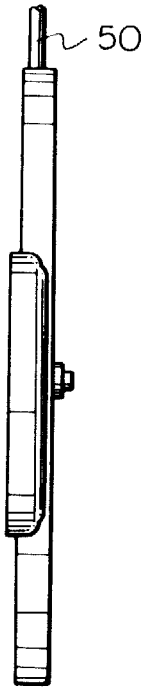
FIG. 6 is a side view of the construction shown in FIG. 5.
Figure 5:
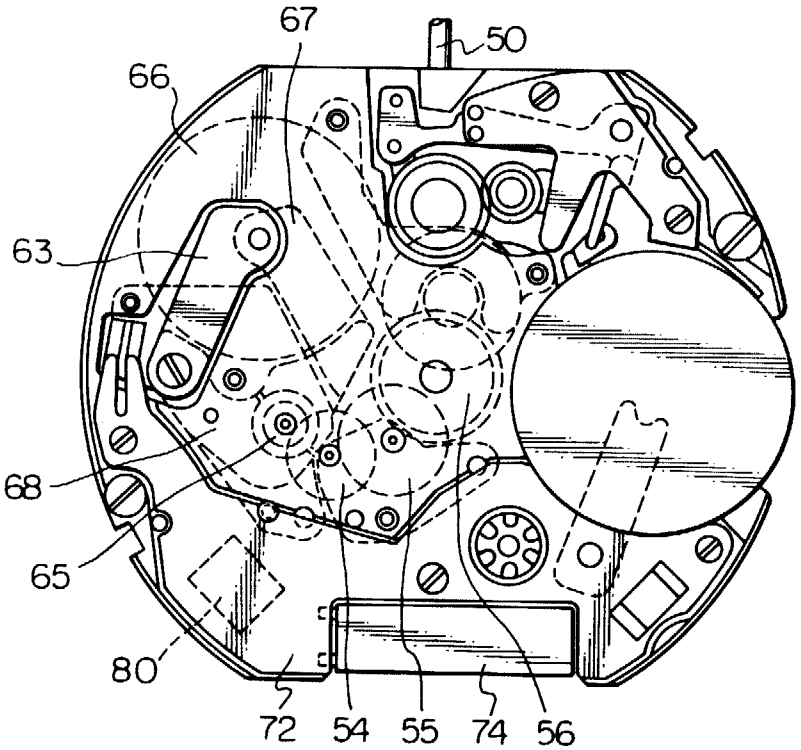
FIG. 5 is a plan view of another preferred embodiment of a watch movement construction according to the present invention.

FIGS. 5 and 6 show a modification of the watch movement shown in FIG. 1. In FIG. 5, the movement is arranged to have a time correction mechanism including a winding crown (not shown) that is attached to a winding stem 50. The arrangement of the cylindrical coil 66, stator 63, lower yoke 67, upper yoke 68, rotor 65, fourth wheel and pinion 54, third wheel and pinion 55 and center wheel and pinion 56 is substantially as described with reference to FIG. 1, the wheels being arranged in an approximate circle substantially concentric with respect to cylindrical coil 66. Circuit board 72 is disposed about the outer periphery of the wheels and provides support for an IC chip 80 and quartz crystal vibrator 74, namely for the oscillating, frequency dividing and driving portions of the timepiece. More specifically, quartz crystal vibrator 74 and its associated oscillator circuit produce a 32768 Hz signal that is frequency divided down to a 1 Hz signal by IC chip 80 in order to drive the stepping motor. A magnetic flux is generated in the stator to drive the rotor by delivering the 1 Hz pulse from the frequency divider circuitry to the cylindrical, flat coil 66. The rotation of the rotor is in turn transmitted to the wheel train to rotate the hands of the wristwatch. The necessary current is supplied by the provision of a battery on the right side of the circuit board.

Figure 7:
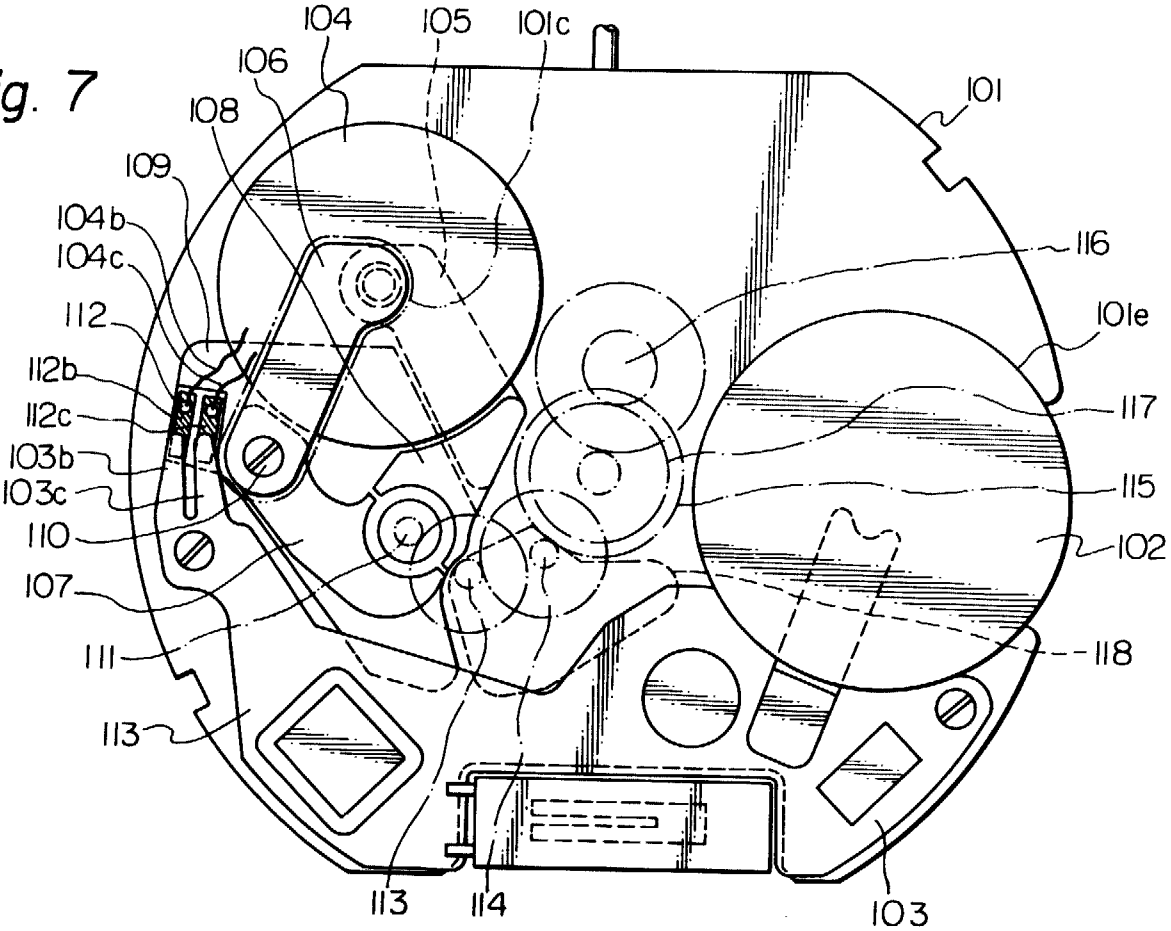
FIG. 7 is a plan view of another preferred embodiment of a watch movement construction according to the present invention.
Figure 8A:
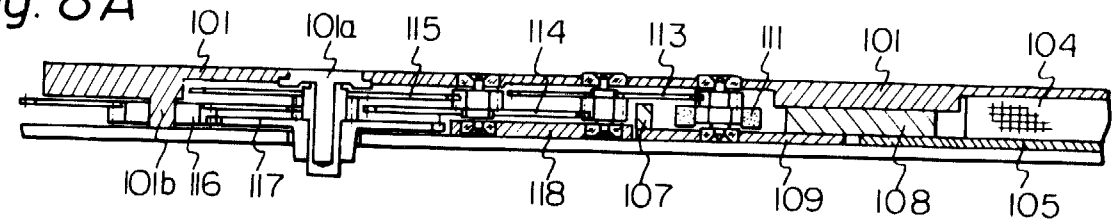
FIGS. 8A, 8B, 8C are cross-sectional views of the principle portions of FIG. 7.
Figure 8B:
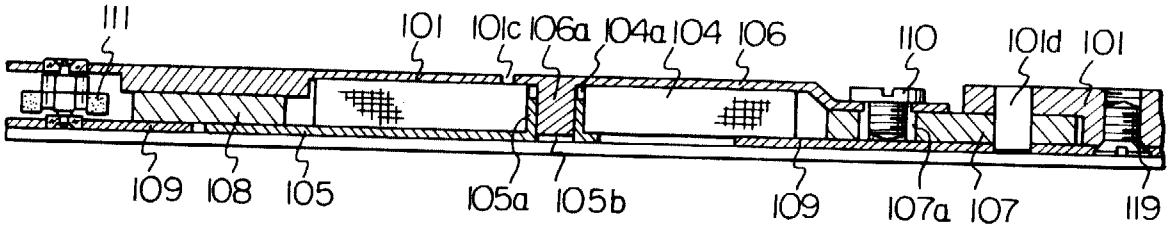
Figure 8C:
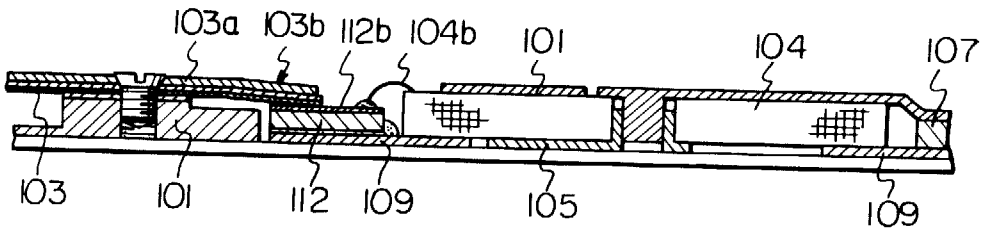

FIG. 7 is a plan view showing another preferred embodiment of the movement construction in accordance with the present invention. FIGS. 8A, 8B, and 8C are cross-sectional views of the principal portions of FIG. 7. In FIG. 7, such mechanisms as a setting wheel and clutch wheel have been deleted for the sake of clarity, and a phantom line is used to indicate only the pitch circles of the wheel train. Only the outer configuration of the plate 101 is shown.

The two-dimensional space of the timepiece movement as defined by the outer configuration of plate 101 is partially occupied by a battery 102, circuit board 103 and cylindrical, flat coil 104 which are disposed along the periphery of the movement. In the present case, battery 102 fits into a cut-out portion 101*e* provided in plate 101, and, as shown in FIG. 8C, circuit board 103 is disposed on the upper surface of plate 101 and coil 104 on the bottom surface. The center hole 104*a* of coil 104 is penetrated by a coil core projection 105*a* provided at a portion of a first yoke 105, the core projection 105*a* having a hole 105*b* into which is press-fitted a columnar projection 106*a* provided at a portion of a second yoke 106. The first and second yokes 105, 106 are therefore mechanically and magnetically joined within center hole 104*a* of coil 104 so that the core projection 105*a* and columnar projection 106*a* form the magnetic core of the coil. A third yoke 107 and fourth yoke 108 constituting a stator of the stepping motor and disposed about rotor 111 as a center so as to confront each other are fixed to a plate 109 and integrated therewith by such means as welding, the plate 109 being made of a non-magnetic material so that a magnetic gap is maintained between the third and fourth yokes 107, 108. The first yoke 105 and fourth yoke 108 are fixedly joined together and integrated by means such as welding at corresponding portions at the periphery of coil 104. In this case the cross-sectional positional relationship is such that plate 109 and first yoke 105 lie on the same horizontal level. Implanted in third yoke 107 is a tube 107*a* into which a screw 110 is tightened to connect third yoke 107 to second yoke 106 at the periphery of the coil 104. From this structure it may readily be understood that a magnetic path in the stepping motor of the present embodiment extends from the first yoke 105 to second yoke 106, third yoke 107, rotor 111, fourth yoke 108 and returns to first yoke 105 in the order mentioned.

Fixed to a portion of plate 109 and integrated therewith by a bonding agent or the like is a synthetic resin terminal board 112 for the coil terminals. More specifically, the upper surface of terminal board 112 is provided with conductive patterns 112*b*, 112*c* each of which consists of a thin metal plate for two corresponding coil terminals. Two wire leads 104*b*, 104*c* from coil 104 are secured to the respective patterns 112*b*, 112*c* by an electrically conductive bondiing agent or the like. Circuit board 103 which is lined with a thin metal reinforcing plate 103*a* includes two finger-shaped portions 103*b*, 103*c* which, by being brought into pressured contact with terminal board 112, electrically connect coil 104 and circuit board 103.

In brief, the construction of the wheel train in the timepiece of the present embodiment is as follows. A driving power is transmitted from the rotor to an hour wheel 117 through a fourth wheel and pinion 113, third wheel and pinion 114, center wheel and pinion 115 and minute wheel 116 in the order mentioned. The shafts that mount rotor 111, fourth wheel and pinion 113 and third wheel and pinion 114 are supported at their upper end by bearings provided in plate 101, the lower end of the rotor shaft being supported by a bearing provided in plate 109, while the lower ends of the shafts of the wheels and pinions 113, 114 are supported by bearings located in a wheel train bridge 118. Center wheel and pinion 115 and hour wheel 117 are axially supported by a post 101*a* implanted in plate 101. As shown in FIG. 8A, wheel train bridge 118 and plate 109 lie on the same horizontal plane, so that the thickness of the movement is greatly reduced. In other words, the thickness of the timepiece movement according to the present embodiment is determined by the distance from the top surface of plate 101 to the bottom surface of wheel train bridge 118, with the bottom surface of the wheel train bridge being located on the same horizontal level as the bottom surface plate 109 and first yoke 105. Moreover, the bottom surface of plate 101 at the shaft support portion 101*b* of minute wheel 116 is located at the same horizontal level as the bottom surface of wheel train bridge 118, plate 109 and first yoke 105, so that the thickness of the movement is actually equivalent to the thickness of plate 101. Meanwhile, the top surface of plate 101 is at the same horizontal level as the top surface of second yoke 106, the plate having a hole 101*c* indicated by the two-dot phantom line of FIG. 7. Since second yoke 106 is disposed in hole 101*c*, the top surface of coil 104 is substantially covered and protected by second yoke 106 and plate 101. Further, the coil block comprising the first through fourth yokes 105 through 108 and the plate 109 is positioned on plate 101 by the implanted pin 101*d*, with plate 109 being secured to the bottom surface of plate 101 by a screw. It is therefore clearly seen from FIG. 8B that the thickness of the timepiece movement according to the present embodiment is equal to the thickness of the coil block or to the thickness of the stepping motor itself.

The procedure for the manufacture and assembly of the abovementioned coil block is as follows. First, third yoke 107 and fourth yoke 108 are secured to doubling plate 109 by welding. In this case, it is permissible to integrally mold the third and fourth yokes in advance and then, after securing them to the doubling plate, separate them into the individual yokes 107, 108 by the formation of a slit. Next, first yoke 105 is secured to the bottom surface of fourth yoke 108, and the integrated structure comprising the first, third and fourth yokes 105, 107, 108 and the plate 109 is subjected to a prescribed heat treatment. Terminal board 112 is then fixed to plate 109 by a bonding agent or the like and is subjected to a heat treatment with regard to third yoke 107. Next, coil core projection 105*a* provided on first yoke 105 of the abovementioned integrated structure is inserted into center hole 104*a* of coil 104, and both of these members are joined by a bonding agent or the like. Columnar projection 106*a* provided on second yoke 106 is inserted into hole 105*b* located in core projection 105*a* to connect the first yoke 105 and second yoke 106. In this case, second yoke 106 is positioned by tube 107*a* implanted in third yoke 107 with the result that coil 104 is embraced from above and below by first yoke 105 and second yoke 106. After second yoke 106 and third yoke 107 are fixedly joined by screw 110, leads 104*b*, 104*c* of coil 104 are fixed to the conductive patterns 112*b*, 112*c* on terminal board 112. Accordingly, third yoke 107 is secured to the abovementioned integrated structure in a detachable manner.

This completes the assembly of the coil block which, as is obvious from the description, is a single integrated block that is extremely easy to handle. Thus, when the coil block is installed in the timepiece movement, it suffices merely to secure plate 109 to the bottom surface of plate 101 by screw 119 etc., with the third yoke 107 and plate 109 being positioned by pin 101*d* implanted in plate 101.

When first yoke 105 and second yoke 106 are joined together, they approximately define a flat V or U-shaped configuration. The reason for this is as follows. When using a flat coil of the type described, first yoke 105 and second yoke 106 are disposed at the top and bottom of coil 104 in extremely close contact thereto. As a result, magnetic leakage develops between the coil 104 and the first and second yokes 105, 106 on either side. The thinner the coil, the shorter the distance between the first and second yokes, a condition which leads to the development of magnetic leakage between these yokes as well. It is obvious that the greater the leakage, the greater the deterioration in the conversion efficiency of the stepping motor. In view of the fact that a wristwatch makes use of a small battery, it is extremely important to minimize the abovementioned magnetic leakage. To this end, the leakage of the former type, namely between the coil 104 and the yokes 105, 106 on either side, can be restrained by minimizing the area defined by the horizontally overlapping portions of the coil 104 and the first and second yokes 105, 106. However, it is also necessary to reduce the thickness of the first and second yokes in order to produce a thin timepiece, and this in turn must be compensated for by increasing the width of the yokes 105, 106. Accordingly, in order to reduce the area of coil 104 overlapped by first and second yokes 105, 106, it is desirable that these yokes be formed to have as linear a configuration as possible. On the other hand, the leakage of the latter type, namely between the first and second yokes themselves, can be reduced by keeping them at a distance from each other, to as great an extent as possible, within substantially the same plane. However, if the first and second yokes 105, 106 were shaped and disposed so as to extend in exactly opposite directions, it is obvious that this would greatly detract from the efficient use of space in the horizontal arrangement of the timepiece. If the first and second yokes were provided with a non-linear shape (such as an L-shaped configuration), the area of overlap with coil 104 would increase and thereby cause an increase in the leakage of the former type. Thus, bearing in mind that the distance between first yoke 105 and second yoke 106 must in any case be shortest in the vicinity of the core of coil 104, it can be understood that the optimum configuration of the two yokes in termis of effective utilization of space and the prevention of a loss in conversion efficiency can be obtained by spreading the yokes into the form of the letter V or U or a shape midway between the two. In such a case, the horizontal portions of first yoke 105 and second yoke 106 in the region outside the periphery of coil 104 may be bent for the sake of design or the like.

Although the first through fourth yokes 105 through 108 define a roughly diamond-like shape when joined together, the third and fourth yokes 107, 108, unlike the first and second yokes 105, 106 which are arranged as dictated by the foregoing reasons, are disposed to conform to the structure and arrangement of the wheel train. In other words, the arrangement of third yoke 107 and fourth yoke 108, in cooperation with the wheel train arrangement from rotor 111 to minute wheel 116, makes the most efficient use of space.

Thus, in accordance with the present invention as described above, it is possible to provide an ultra-thin movement equipped with stepping motor, which can be easily assembled and handled and which exhibits a comparatively good conversion efficiency despite the use of a flat coil.

Although third yoke 107 and fourth yoke 108 in the present embodiment are formed so as to be independent of each other, it would suffice if the two were merely substantially separated from each other, that is, merely by maintaining a magnetic gap between them. It is obvious that the present invention could be applied even if, for example, the two yokes have a connected shape, i.e., even if the yokes are of the so-called slitless type.

What is claimed is:

1. A movement construction for an electronic wristwatch driven by a stepping motor powered by a battery, comprising:

a base plate having a first cutout formed in close proximity to one portion of an outer periphery of said base plate to accommodate therein said battery, and a second cutout formed in close proximity to another portion of the outer periphery of said base plate;

a disk type driving coil forming part of said stepping motor and disposed in said second cutout of said base plate, said disk type driving coil having its upper and lower end surfaces substantially aligned on the same plane as upper and lower surfaces of said base plate;

a wheel train mounted on said base plate in an area between said battery and said driving coil in a manner to be concentric with said driving coil; and a circuit board having an IC chip and a quartz crystal vibrator mounted in horizontal spaces, respectively, and supported by said base plate outside an area occupied by said driving coil, said battery and said wheel train which are aligned in a single plane.

2. A movement construction according to claim 1, further comprising a plate member secured to one surface of said base plate, a stator disposed in substantially the same plane with said base plate and supported by said member, and first and second yokes secured to upper and lower surfaces of said driving coil.

3. A movement construction according to claim 2, in which said first and second yokes are fixedly connected to said stator by which said driving coil is supported.

4. A movement construction according to claim 2, in which said base plate includes a thinned portion extending below said driving coil to limit an axial movement thereof.

5. A movement construction according to claim 2, further comprising third and fourth yokes secured to said plate member, said third and fourth yokes being connected to said second and first yokes respectively at positions outside an area occupied by said driving coil.

6. A movement construction according to claim 5, in which said plate member and said first yoke are placed substantially on the same plane with respect to one another.

7. A movement construction according to claim 6, in which said first yoke is aligned on substantially the same plane with one surface of said base plate.

8. A movement construction according to claim 6, in which said plate member is made of non-magnetic material.

9. A movement construction according to claim 5, wherein said first, second, third and fourth yokes are arranged so as to define a horizontally disposed substantially diamond-shaped configuration when in the interconnected state.

10. A movement construction for an electronic wristwatch driven by a stepping motor powered by a battery, comprising:

a base plate having a first cutout formed in a first area in close proximity to one portion of an outer periphery of said base plate to accommodate therein said battery, a second cutout formed in a second area in close proximity to another portion of the outer periphery of said base plate, and a third cutout formed in a third area other than said first and second areas;

a driving coil forming part of said stepping motor and disposed in said second cutout of said base plate, said driving coil having its upper and lower surfaces substantially aligned with upper and lower surfaces of said base plate;

a wheel train mounted on said base plate in an area between said first and second areas in a manner to be concentric with said driving coil and in substantially the same plane with said driving coil and said battery; and a circuit board having an IC chip and a quartz crystal vibrator mounted in horizontal spaces, respectively, said circuit board being disposed in said third cutout of said base plate in out of axial overlapping relationship with respect to said driving coil and said battery.

11. A movement construction according to claim 10, further comprising a plate member secured to one surface of said base plate, a stator disposed in substantially the same plane with said base plate and supported by said plate member, and first and second yokes secured to the upper and lower surfaces of said driving coil.

12. A movement construction according to claim 11, in which said first and second yokes are fixedly connected to said stator, and in which the upper and lower surfaces of said driving coil are secured by said first and second yokes, respectively.

13. A movement construction according to claim 11, in which said base plate includes a thinned portion extending below said driving coil to limit an axial movement thereof.

14. A movement construction according to claim 11, further comprising third and fourth yokes secured to said plate member, said third and fourth yokes being connected to said second and first yokes, respectively, at positions outside an area occupied by said driving coil.

15. A movement construction according to claim 14, in which said plate member and said first yoke are placed substantially on the same plane with respect to one another.

16. A movement construction according to claim 15, in which said first yoke is aligned on substantially the same plane with one surface of said base plate.

17. A movement construction according to claim 15 or 16, in which said plate member is made of non-magnetic material.

18. A movement construction according to claim 14, wherein said first, second, third and fourth yokes are arranged so as define a horizontally disposed substantially diamond-shaped configuration when in the interconnected state.

19. A movement construction according to claim 10, in which said stepping motor comprises a rotor including a rotor stem having its axial length substantially equal to a thickness of said movement construction, and disposed substantially in the same plane with said wheel train.

20. A movement construction for an electronic wristwatch driven by a stepping motor powered by a battery, comprising:

a base plate having a first cutout formed in close proximity to one portion an outer periphery of said base plate to accommodate therein said battery, and a second cutout formed in close proximity to another portion of the outer periphery of said base plate;

a cylindrical, flat driving coil forming part of said stepping motor and disposed in said second cutout of said base plate;

a wheel train mounted on said base plate in an area between said battery and said driving coil in a manner to be concentric with said driving coil;

a plate member secured to one surface of said base plate;

a stator disposed in substantially the same plane with said base plate and supported by said plate member;

first and second yokes secured to upper and lower surfaces of said driving coil;

third and fourth yokes secured to said plate member, said third and fourth yokes being connected to said second and first yokes, respectively, at positions outside an area occupied by said driving coil;

said plate member and said first yoke being placed substantially on the same plane with respect to one another;

said plate member being made of non-magnetic material.

21. A movement construction for an electronic wristwatch driven by a stepping motor powered by a battery, comprising:

a base plate having a first cutout formed in a first area in close proximity to one portion of an outer periphery of said base plate to accommodate therein said battery, a second cutout formed in a second area in close proximity to another portion of the outer periphery of said base plate, and third cutout formed in a third area other than said first and second areas;

a cylindrical, flat driving coil forming part of said stepping motor and disposed in said second cutout of said base plate, said driving coil including an axis extending parallel to the axis of said movement construction and having its upper and lower end surfaces substantially aligned with upper and lower surfaces of said base plate;

a wheel train mounted on said base plate outside an area occupied by said battery and driving coil in a manner to be concentric with said driving coil and in substantially the same plane with said driving coil and said battery; and a circuit board having an IC chip and a quartz crystal vibrator mounted in horizontal spaces, respectively, said circuit board being disposed in said third cutout of said base plate in out of axial overlapping relationship with respect to said driving coil and said battery.

22. A movement construction according to claim 21, further comprising a plate member secured to one surface of said base plate, a stator disposed in substantially the same plane with said base plate and supported by said plate member, and first and second yokes secured to the upper and lower surfaces of said driving coil.

23. A movement construction according to claim 22, in which said first and second yokes are fixedly connected to said stator, and in which the upper and lower end surfaces of said driving coil are secured by said first and second yokes, respectively.

24. A movement construction according to claim 22, in which said base plate includes a thinned portion extending below said driving coil to limit an axial movement thereof.

25. A movement construction according to claim 22, further comprising third and fourth yokes secured to said plate member, said third and fourth yokes being connected to said second and first yokes, respectively, at positions outside an area occupied by said driving coil.

26. A movement construction according to claim 25, in which said plate member and said first yoke are placed substantially on the same plane with respect to one another.

27. A movement construction according to claim 26, in which said first yoke is aligned on substantially the same plane with one surface of said base plate.

28. A movement construction according to claim 26 or 27, in which said plate member is made of non-magnetic material.

29. A movement construction according to claim 25, wherein said first, second, third and fourth yokes are arranged so as to define a horizontally disposed substantially diamond-shaped configuration when in the interconnected state.

30. A movement construction according to claim 21, in which said stepping motor comprises a rotor including a rotor stem having its axial length substantially equal to a thickness of said movement construction, and disposed substantially in the same plane with said wheel train.

31. A movement construction for an electronic wristwatch having time indicating hands, and a back cover and driven by a stepping motor powered by a battery, comprising:

a watch dial having a central bore formed therein;

a base plate having a first cutout formed in a first area in close proximity to one portion of an outer periphery of said base plate to accommodate therein said battery, and a second cutout formed in a second area other than said area in close proximity to another portion of the outer periphery of said base plate;

a cylindrical driving coil forming part of said stepping motor and disposed in the second cutout of said base plate;

a wheel train mounted on said base plate in a central portion of said movement construction in a space horizontally aligned with said driving coil, said wheel train including a central post for supporting said time indicating hands, said central post having one end substantially aligned with one surface of said movement construction at a central portion of said movement construction and extending throughout the central bore of said watch dial;

said movement construction having a thickness of less than 2.5 mm.

32. A movement construction according to claim 31, in which said stepping motor comprises a rotor including a rotor stem having its axial length substantially equal to the thickness of said movement construction.

33. A movement construction according to claim 31, in which each of said stepping motor and said wheel train has a thickness substantially equal to the thickness of said movement construction.

34. A movement construction for an electronic wristwatch having time indicating hands, and a back cover and driven by a stepping motor powered by a battery, comprising:

a watch dial having a central bore formed therein;

a base plate having a first cutout formed in a first area in close proximity to one portion of an outer periphery of said base plate to accommodate therein said battery, and a second cutout formed in a second area other than said first area in close proximity to another portion of the outer periphery of said base plate;

a cylindrical driving coil forming part of said stepping motor and disposed in the second cutout of said base plate;

a wheel train mounted on said base plate in a central portion of said movement construction in a space horizontally aligned with said driving coil, said wheel train including a central post for supporting said time indicating hands, said central post having one end substantially aligned with one surface of said movement construction and extending throughout the central bore of said watch dial;

a circuit board supported by said base plate outside an area occupied by said driving coil, said battery and said wheel train which are aligned in a single plane;

said movement construction having a thickness of less than 2.5 mm.

* * * * *